US008677670B2

(12) United States Patent
Christensen et al.

(10) Patent No.: US 8,677,670 B2
(45) Date of Patent: Mar. 25, 2014

(54) SEGMENTED COMPOSITE BARREL FOR WEAPON

(76) Inventors: Jason Christensen, Gunnison, UT (US); Roland J. Christensen, Gunnison, UT (US)

( * ) Notice: Subject to any disclaimer, the term of this patent is extended or adjusted under 35 U.S.C. 154(b) by 141 days.

(21) Appl. No.: 12/985,040

(22) Filed: Jan. 5, 2011

(65) Prior Publication Data

US 2011/0173864 A1 Jul. 21, 2011

Related U.S. Application Data

(60) Provisional application No. 61/292,616, filed on Jan. 6, 2010.

(51) Int. Cl.
*F41A 21/00* (2006.01)

(52) U.S. Cl.
USPC ..... 42/78; 89/16; 89/14.7

(58) Field of Classification Search
USPC ..... 89/14.6–16
See application file for complete search history.

(56) References Cited

U.S. PATENT DOCUMENTS

| | | | | |
|---|---|---|---|---|
| 1,309,163 | A | 7/1919 | Walpole | |
| 1,748,272 | A * | 2/1930 | McCann et al. | 89/16 |
| 1,808,052 | A * | 6/1931 | McCann | 89/16 |
| 2,112,144 | A | 3/1938 | Coupland | |
| 2,847,786 | A | 8/1958 | Hartley et al. | |
| 2,850,828 | A * | 9/1958 | Sullivan | 42/76.02 |
| 2,935,912 | A * | 5/1960 | Hartley | 89/14.1 |
| 2,935,913 | A | 5/1960 | Wilson | |
| 3,004,361 | A | 10/1961 | Hammer | |
| 3,340,769 | A * | 9/1967 | Waser | 89/14.5 |
| 3,571,962 | A | 3/1971 | Eig | |
| 3,641,870 | A | 2/1972 | Eig | |
| 3,742,640 | A * | 7/1973 | Thomsen | 42/76.01 |
| 4,435,455 | A | 3/1984 | Prewo et al. | |
| H82 | H | 7/1986 | Dittrich et al. | |
| 4,641,450 | A | 2/1987 | Moll et al. | |
| 4,646,615 | A | 3/1987 | Gladstone et al. | |
| 4,669,212 | A | 6/1987 | Jackson et al. | |
| 4,685,236 | A | 8/1987 | May | |
| 4,756,677 | A | 7/1988 | Hribernik et al. | |
| 4,911,060 | A | 3/1990 | Greenspan et al. | |
| 5,125,179 | A | 6/1992 | Campbell et al. | |
| 5,160,802 | A | 11/1992 | Moscrip | |

(Continued)

FOREIGN PATENT DOCUMENTS

| | | |
|---|---|---|
| CA | 2070071 | 12/1992 |
| JP | 6101993 | 4/1994 |

OTHER PUBLICATIONS http://www.printthis.clickability.com/pt/cpt?action=cpt&title-Carbon%2; printed Nov. 10, 2009; "Shooting".

(Continued)

*Primary Examiner* — Samir Abdosh
(74) *Attorney, Agent, or Firm* — Thorpe North & Western LLP

(57) ABSTRACT

A rifle barrel for a gas-operated rifle includes a metallic liner with a longitudinal bore and a transverse gas port through the liner to the bore intermediate along a length of the liner. A thermally conductive sleeve circumscribes the liner substantially along the length of the liner. A composite wrap circumscribes the sleeve substantially along a length of the sleeve. The composite wrap is separated from the gas port.

20 Claims, 2 Drawing Sheets

(56) References Cited

U.S. PATENT DOCUMENTS

| | | | | |
|---|---|---|---|---|
| 5,214,234 | A | 5/1993 | Divecha et al. | |
| 5,309,814 | A * | 5/1994 | Mossberg | 89/14.6 |
| 5,341,719 | A | 8/1994 | Bullis et al. | |
| H1365 | H | 11/1994 | Amspacker et al. | |
| 5,448,940 | A | 9/1995 | Schuetz et al. | |
| 5,657,568 | A | 8/1997 | Christensen | |
| 5,692,334 | A * | 12/1997 | Christensen | 42/76.02 |
| 5,804,756 | A * | 9/1998 | Christensen | 89/15 |
| 5,915,937 | A * | 6/1999 | Christensen | 42/76.02 |
| 6,314,857 | B1 * | 11/2001 | Schmidt et al. | 89/14.1 |
| 6,889,464 | B2 * | 5/2005 | Degerness | 42/76.02 |

OTHER PUBLICATIONS

"ABS"; 2004 Advanced Barrel Systems, Inc.; modified Dec. 3, 2004.

PCT Application PCT/US2011/020330; filed Jan. 6, 2011; Jason Christensen; International Search Report mailed Dec. 27, 2011.

* cited by examiner

SEGMENTED COMPOSITE BARREL FOR WEAPON

PRIORITY CLAIM

Priority is claimed to U.S. Provisional Patent Application Ser. No. 61/292,616, filed Jan. 6, 2010, which is hereby incorporated herein by reference in its entirety.

BACKGROUND

1. Field of the Invention

The present invention relates generally to composite barrels for weapons, such as rifles and automatic or semi-automatic weapons.

2. Related Art

Light-weight, high-strength composite barrels have been developed with a carbon fiber wrap over a steel barrel liner. For example, see U.S. Pat. Nos. 5,804,756; 5,657,568; 5,692,334; 5,915,937; and 6,889,464.

Such barrels, however, face difficulties when incorporated into an automatic weapon. For example, barrel temperatures in automatic weapons can exceed the melting point of the composite or epoxy resin thereof As another example, some automatic weapons utilize gas-operated reloading in which high pressure gas from the fired cartridge is utilized to power a mechanism to expel the spent case and load a new cartridge. The high pressure gas is taken from a gas port in the barrel downstream of the chamber. The high temperature gas can degrade and/or melt the composite or epoxy resin around the gas port. Simply wrapping the composite around a tube from the gas port has been found to sheer the tube as the liner and composite wrap have different coefficients of thermal expansion.

SUMMARY OF THE INVENTION

It has been recognized that it would be advantageous to develop a light-weight, high-strength composite barrel for weapons, such rifles or automatic or semi-automatic weapons.

The invention provides a rifle barrel for a gas-operated automatic rifle including a metallic liner with a longitudinal bore and a transverse gas port through the liner to the bore intermediate along a length of the liner. A thermally conductive sleeve circumscribes the liner substantially along the length of the liner. A composite wrap circumscribes the sleeve substantially along a length of the sleeve. The composite wrap is separated from the gas port.

In accordance with a more detailed aspect of the invention, the composite wrap can include two discrete wraps separated longitudinally from one another along the length of the liner with a gap therebetween corresponding to the gas port. A protrusion can be formed in the liner at the gas port and can correspond to the gap between the two discrete wraps. The sleeve can include two discrete sleeves separated longitudinally from one another along the length of the liner with a gap therebetween corresponding to the gas port and the protrusion.

In accordance with another more detailed aspect of the invention, the composite wrap can include two discrete wraps separated longitudinally from one another along the length of the liner with a gap therebetween corresponding to the gas port. A protrusion can be formed in the sleeve at the gas port and can correspond to the gap between the two discrete wraps.

In accordance with another more detailed aspect of the invention, the sleeve can include two discrete sleeves separated longitudinally from one another along the length of the liner with a gap therebetween corresponding to the gas port.

In accordance with another more detailed aspect of the invention, the sleeve can include a carbon foam.

In addition, the invention provides a method for manufacturing a rifle barrel for a gas-operated automatic rifle, comprising: machining a liner from metal stock; machining a sleeve from stock; sliding the sleeve over the liner; and wrapping the sleeve with a composite wrap in two separate longitudinal sections.

Furthermore, the invention provides a rifle barrel for a weapon including a metallic liner with a longitudinal bore. A thermally conductive sleeve circumscribes the liner substantially along a length of the liner. A composite wrap circumscribes the sleeve substantially along a length of the sleeve.

In accordance with a more detailed aspect of the invention, the sleeve can include a carbon foam.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Definitions

The term "gas-operated automatic or semi-automatic rifle" is used broadly to refer to an automatic or semi-automatic weapon (or both), whether configured as a rifle or a pistol, that utilizes a gas-operated reloading mechanism, and includes any weapon designated as an M16, AK-47, M4, or versions including such designations.

The term "carbon foam" is used to refer to a microcellular carbon graphitic foam that contains an open-celled microcellular/carbon graphitic network created from carbon fiber precursors. Such carbon foam is rigid and self supporting, and can be obtained as preformed as stock or bar stock, and machined to the desired shape. The carbon foam can be thermally conductive. For example, the carbon foam can have a thermal conductivity greater than higher than 50 W/mK. The carbon foam can have a melting point greater than 2000° C. In addition, the carbon foam can have essentially a zero coefficient of thermal expansion through the operating temperature, or has essentially no thermal expansion.

Description

Figure 1:
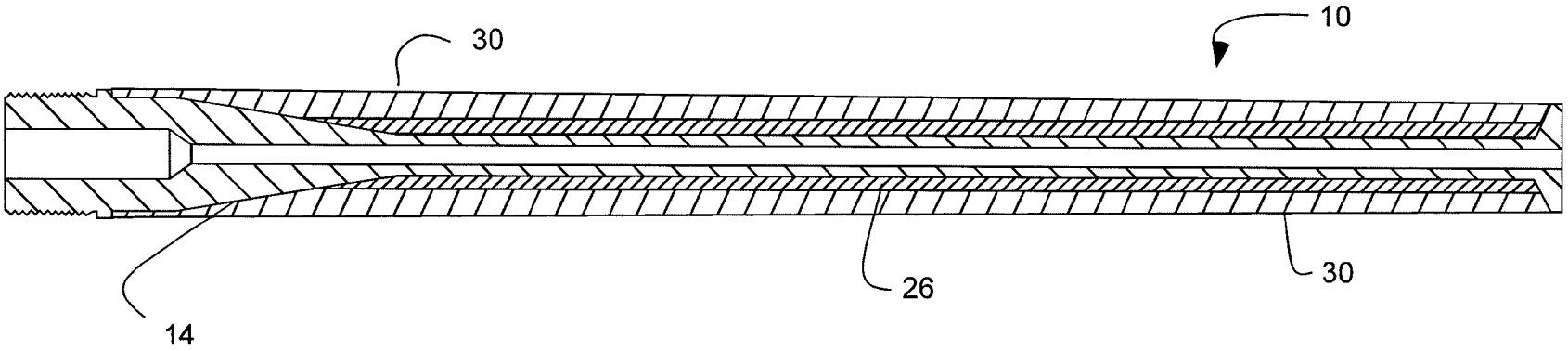
FIG. 1 is a cross-sectional side view of a barrel in accordance with an embodiment of the present invention.

As illustrated in FIG. 1, a rifle barrel device, indicated generally at 10, in an example implementation in accordance with the invention is shown. Such a barrel 10 can be utilized in an automatic weapon or rifle, such as an M16, with a gas-operated reloading mechanism.

The barrel 10 can include a metallic liner 14 with a longitudinal bore 18. The liner can be formed of metal, such as stainless steel, and can be manufactured by machining from blank material, such as rod stock. The outer diameter and shape can be machined, such as on a lathe; while the inner bore can be formed by rifling, as is known in the art. The liner can also include or can form a chamber. Thus, the proximal end of the liner can have a greater outer diameter than a majority of the length of the liner to accommodate the chamber. The outer diameter of the liner can taper or have a taper neat the proximal end and proximate the chamber. Similarly, the proximal end of the liner can have a greater inner diameter than the majority of the length of the liner and/or the distal end to accommodate the chamber. In addition, the liner can include mechanism to secure the barrel to the stock or remainder of the rifle, such as screw threads at a proximal end. An outer diameter of the distal end of the liner can have a flare or increased diameter with respect to an outer diameter of a majority of the length of the liner.

A thermally conductive sleeve 26 can circumscribe the liner 14 substantially along the length of the liner. The sleeve can be formed of thermally conductive material, such as carbon foam, and can be manufactured by machining from blank material and sliding the sleeve over the liner. Alternatively, the sleeve can be machined as halves that can sandwich the liner. The thermally conductive sleeve can have an interior shape and dimension that substantially matches the outer shape and diameter of the liner such that the inner surface of the sleeve abuts to the outer surface of the liner. Thus, the sleeve can have a reduced thickness and/or tapered inner diameter at its proximal and/or distal ends to match the increased outer diameter of the liner at its proximal and/or distal ends. The thermally conductive sleeve can conduct heat away from the liner during firing, particularly during rapid repeated firing, such as with an automatic weapon. The thermally conductive sleeve can have a high heat tolerance and/or high melting point, for example approximately 2000° C. or more. It will be appreciated that the gases in the liner can be between approximately 1000-2000° C.

A composite wrap 30 can circumscribe the sleeve 26 substantially along the length of the sleeve and liner. The composite wrap can include a fiber in a resin matrix, such as a carbon fiber. The composite wrap can be applied by winding, as is known in the art. Thus, the composite wrap 30 is separated from the liner 14, and the heat associated therewith, by the thermally conductive sleeve 26. The sleeve thus protects the composite wrap, or epoxy resin thereof The wrap can be longitudinally segmented to form two discrete wraps or segments separated longitudinally from one another along the length of the liner with a gap therebetween corresponding to and to accommodate a gas port. The proximal or rearward wrap can abut to a ring prior to the gas port.

Although described for use with an automatic weapon or rifle, it will be appreciated that the above barrel can be used with other types of weapons and rifles, including non-automatic rifles or semi-automatic rifles.

Figure 2:
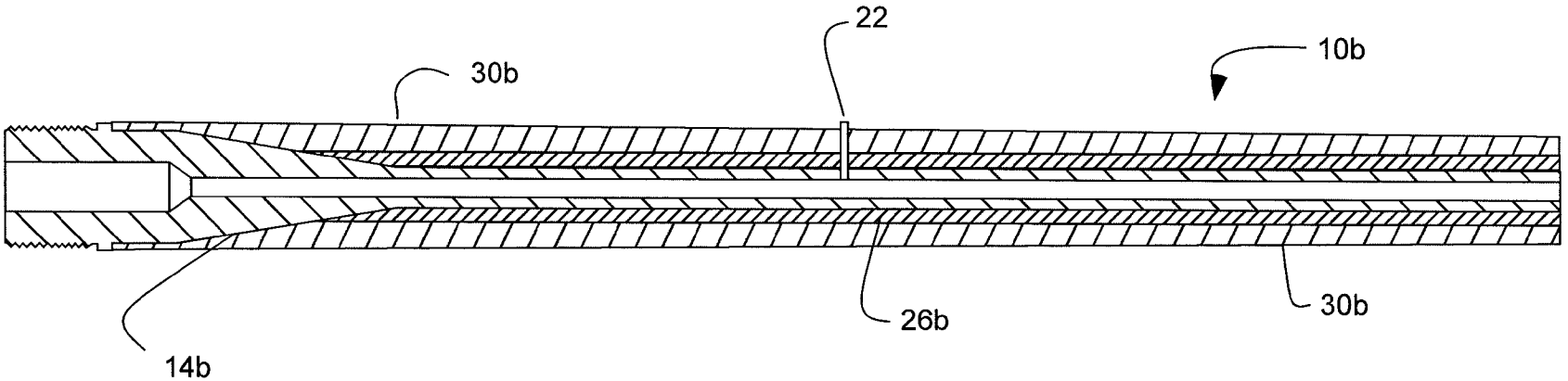
FIG. 2 is a cross-sectional side view of another barrel in accordance with another embodiment of the present invention.

Referring to FIG. 2, a gas-operated automatic rifle barrel device 10*b* is shown that is similar in most respects to that described above, and which description is herein incorporated by reference. In addition, the liner 14*b* has a transverse gas port 22 through the liner to the bore intermediate along a length of the liner. In addition, the gas port can also extend through the sleeve 26*b*. Furthermore, the gas port can extend through the composite wrap 30*b*. The composite wrap can be separated from the gas port. For example, a metallic tube can be inserted through the gas port in the wrap and sleeve and can tap into the liner. The gas port can be coupled by a gas tube of a gas-operated reloading mechanism, as is known in the art. The composite wrap 30*b* is separated from the gas port 22 by the metallic tube and the sleeve.

Figure 3:
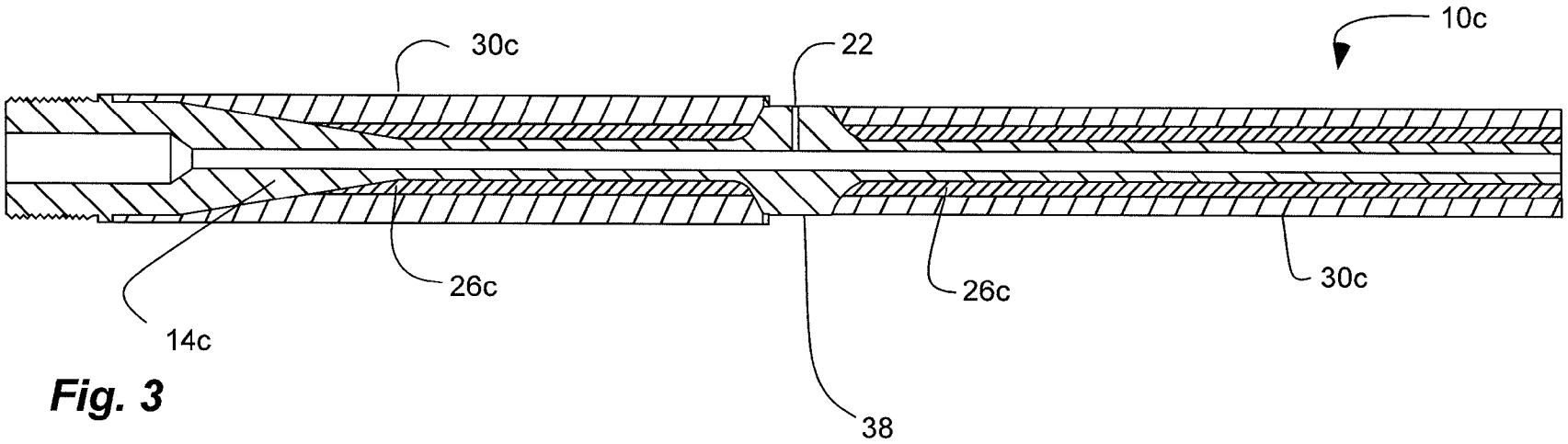
FIG. 3 is a cross-sectional side view of another barrel in accordance with another embodiment of the present invention.

Referring to FIG. 3, another gas-operated automatic rifle barrel device 10*c* is shown that is similar in most respects to that described above, and which descriptions are herein incorporated by reference. In addition, the liner 14*c* has a gas port 22 through the liner to the bore intermediate along a length of the liner. The gas port can be coupled by a gas tube of a gas-operated reloading mechanism, as is known in the art. The composite wrap 30*c* is separated from the gas port 22. The composite wrap 30*c* can be longitudinally segmented into two discrete wraps or segments along the length of the liner and longitudinally separated from one another by a gap corresponding to the gas port 22. The wraps can include rearward and forward wraps or segments, or proximal and distal wraps or segments. The wraps can be wound separately.

A protrusion 38 can be formed in the liner 14*c*, such as by machining, at the gas port 22, and can corresponding to the gap between the two discrete wraps. Thus, the protrusion 38 separates the composite wrap, and epoxy resin thereof, from the gas port or gas tube. The protrusion can be annular.

In addition, the sleeve 26*c* can be longitudinally segmented and can include two discrete sleeves longitudinally separated from one another along the length of the liner with a gap therebetween corresponding to the gas port and the protrusion. The sleeves can include rearward and forward sleeves, or proximal and distal sleeves.

Figure 4:
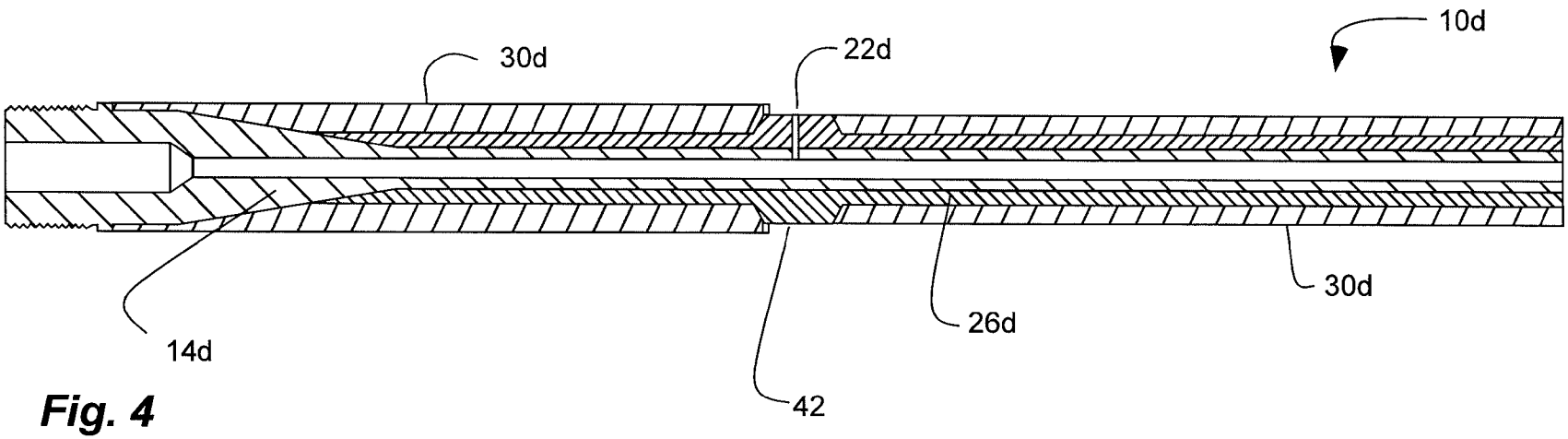
FIG. 4 is a cross-sectional side view of another barrel in accordance with another embodiment of the present invention.

Referring to FIG. 4, another gas-operated automatic rifle barrel device 10*d* is shown that is similar in most respects to those described above, and which descriptions are herein incorporated by reference. In addition, the sleeve 26*d* has a gas port 22*d* corresponding to the gas port 22 of the liner.

A protrusion 42 can be formed in the sleeve 26*d* at the gas port 22 and 22*d* and corresponding to the gap 38 and/or 42 between the two discrete wraps and/or sleeve 30*d* and/or 26*d*. The protrusion can be annular. Thus, the composite wrap is separated from the gas port by the protrusion of the sleeve.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A rifle barrel device for a gas-operated automatic or semi-automatic rifle, the device comprising:

a) a metallic liner with a longitudinal bore and a transverse gas port through the liner to the bore intermediate along a length of the liner;

b) a thermally conductive sleeve circumscribing the liner substantially along the length of the liner;

c) the sleeve being continuous along the length of the liner and including a gas port aligned with the gas port of the liner;

d) a composite wrap circumscribing the sleeve substantially along a length of the sleeve;

e) the wrap being longitudinally discontinuous along the length of the liner and including a gap corresponding to the gas ports of the liner and the sleeve f) the composite wrap being separated from the gas port;

g) the thermally conductive sleeve and the composite wrap being different materials; and h) the composite wrap comprising fiber in a resin matrix; and i) the thermally conductive sleeve comprising carbon foam.

2. A device in accordance with claim 1, wherein the composite wrap includes two discrete wraps separated longitudinally from one another along the length of the liner with a gap therebetween corresponding to the gas port.

3. A device in accordance with claim 2, further comprising:

a protrusion formed in the liner at the gas port and corresponding to the gap between the two discrete wraps.

4. A device in accordance with claim 1, further comprising:

a protrusion formed in the liner at the gas port.

5. A device in accordance with claim 1, further comprising:

a protrusion formed in the sleeve at the gas port.

6. A rifle barrel device for a gas-operated automatic or semi-automatic rifle, the device comprising:

a) a metallic liner with a longitudinal bore and a transverse gas port through the liner to the bore intermediate along a length of the liner;

b) a thermally conductive sleeve circumscribing the liner substantially along the length of the liner;

c) the sleeve being continuous along the length of the liner and including a gas port aligned with the gas port of the liner;

d) a composite wrap circumscribing the sleeve substantially along a length of the sleeve;

e) the wrap being longitudinally discontinuous along the length of the liner and including a gap corresponding to the gas ports of the liner and the sleeve; and f) the composite wrap being separated from the gas port.

7. A device in accordance with claim 1, wherein the thermally conductive sleeve has a thermal conductivity greater than 50 W/mK.

8. A device in accordance with claim 1, wherein the thermally conductive sleeve has a melting point greater than 2000° C.

9. A device in accordance with claim 1, wherein the thermally conductive sleeve has essentially a zero coefficient of thermal expansion through operating temperatures of the rifle.

10. A device in accordance with claim 1, wherein the composite wrap is separated from the metallic liner by the thermally conductive sleeve.

11. A device in accordance with claim 6, wherein the thermally conductive sleeve and the composite wrap are different materials.

12. A device in accordance with claim 6, wherein the composite wrap comprises fiber in a resin matrix; and wherein the thermally conductive sleeve comprises carbon foam.

13. A device in accordance with claim 6, wherein the composite wrap includes two discrete wraps separated longitudinally from one another along the length of the liner with a gap therebetween corresponding to the gas port.

14. A device in accordance with claim 13, further comprising:

a protrusion formed in the liner at the gas port and corresponding to the gap between the two discrete wraps.

15. A device in accordance with claim 6, further comprising:

a protrusion formed in the liner at the gas port.

16. A device in accordance with claim 6, further comprising:

a protrusion formed in the sleeve at the gas port.

17. A device in accordance with claim 6, wherein the thermally conductive sleeve has a thermal conductivity greater than 50 W/mK.

18. A device in accordance with claim 6, wherein the thermally conductive sleeve has a melting point greater than 2000° C.

19. A device in accordance with claim 6, wherein the thermally conductive sleeve has essentially a zero coefficient of thermal expansion through operating temperatures of the rifle.

20. A device in accordance with claim 6, wherein the composite wrap is separated from the metallic liner by the thermally conductive sleeve.

* * * * *